United States Patent [19]

Matsushima

[11] Patent Number: 4,517,428

[45] Date of Patent: May 14, 1985

[54] MENU DISPLAY DEVICE

[75] Inventor: Kazufumi Matsushima, Fuji, Japan

[73] Assignee: Tokyo Shibaura Denki Kabushiki Kaisha, Japan

[21] Appl. No.: 381,512

[22] Filed: May 24, 1982

[30] Foreign Application Priority Data

May 29, 1981 [JP] Japan ..... 56-78870[U]
Jun. 19, 1981 [JP] Japan ..... 56-90257[U]

[51] Int. Cl.[3] ..... H05B 6/06
[52] U.S. Cl. ..... 219/10.55 B; 340/815.06
[58] Field of Search ..... 219/10.55 B, 10.55 E, 219/10.55 M; 368/222, 78; 340/815.08, 815.09, 815.06

[56] References Cited

U.S. PATENT DOCUMENTS 928,193 7/1909 Harrison et al. ..... 340/815.09 X
4,028,517 6/1977 Tanaka et al. ..... 219/10.55 B
4,324,966 4/1982 Tanabe ..... 219/10.55 B

FOREIGN PATENT DOCUMENTS 52-50448 11/1977 Japan .

*Primary Examiner*—C. L. Albritton
*Assistant Examiner*—M. M. Lateef
*Attorney, Agent, or Firm*—Cushman, Darby & Cushman

[57] ABSTRACT

A microwave oven is equipped with a menu display device. In this device, a plurality of menu cards are turnably attached at their one end to the outer peripheral surface of a menu card bobbin which is rotatably supported on a shaft. A gear is mounted on the shaft of the menu card bobbin and connected to a motor, permitting the bobbin to be rotated. A curved transparent cover is fixed to a front panel of the microwave oven such that it faces the bobbin. Between the concave surface of the transparent cover and the menu card bobbin a path is defined where the menu cards are turnably moved. The convex surface of the transparent cover projects from the front panel to permit an adequate amount of external light to be received. To the rear side of the front panel a partition plate is fixed against the end of which the other end of the menu card abuts, and holds the abutting menu card erect.

8 Claims, 9 Drawing Figures

P19

APPLE PIE

| | | |
|---|---|---|
| MATERIAL | FLOUR | : 800g |
| | SALT | : ONE SPOONFUL |
| | BUTTER | : 200g |
| | APPLES | : 4 |
| METHOD FOR COOKING | ① STRONG MODE OF A RANGE : 18 MINUTES | |
| | ② OVEN : 220°C, 20 MINUTES | |

MENU DISPLAY DEVICE

BACKGROUND OF THE INVENTION

This invention relates to a cooking apparatus and in particular to a menu display device for cooking apparatus.

With a cooking apparatus, for example, a microwave oven, it is generally convenient to display, prior to cooking, a menu on which a cooking mode, setting time, setting temperature, etc. appropriate for the kinds of foods or the items of cooking are written. A "leaf" type menu display device is set forth in Japanese Utility Model Publication No. 52-50448 published on Nov. 16, 1977. In this leaf type menu display device a number of menu cards are attached to the outer peripheral surface of a rotating drum and, when the rotating drum is manually rotated by the user, a pair of desired menu cards are visually located in a display window, thereby permitting a number of menu cards to be displayed. With the conventional menu display device, the menu cards are visually turned by operating a rotation knob of the rotating drum, which is provided in front of a front panel. Since, however, the rotating drum is located away from the front panel and the menu card is located in a position receding from the front panel, only a small amount of light is incident to the menu card, making it difficult to read the menu items on the menu card. It is also difficult to read the menu items on the menu card in the directions other than a front direction.

SUMMARY OF THE INVENTION

It is accordingly the object of the invention to provide a menu display device which enables an operator to readily and precisely read menu items on menu cards.

Another object of this invention is to provide a menu display device which can positively locate a pair of desired menu cards with respect to a cooking instruction.

According to this invention a device is provided to display a pair of menu cards at a time. A number of menu cards are turnably attached at one end to the outer peripheral surface of a cylindrical bobbin which in turn is connected to a rotation mechanism. With the rotation of the bobbin the menu cards are sequentially presented with respect to the cooking instruction. A curved transparent cover is fixed to the casing of the cooking apparatus and has its convex surface projected from the surface of the casing. The concave surface of the transparent cover faces the bobbin between which a spacing is defined to permit the menu cards to be turned. The transparent cover has a radius of curvature greater than a radius of the bobbin to permit external light to be adequately incident to the menu cards. A stopper is secured to the casing and has an end against which the other end of the menu card abuts, and holds the abutting menu card erect while the bobbin is stopped.

DETAILED DESCRIPTION OF THE PREFERRED EMBODIMENT

Figure 1:
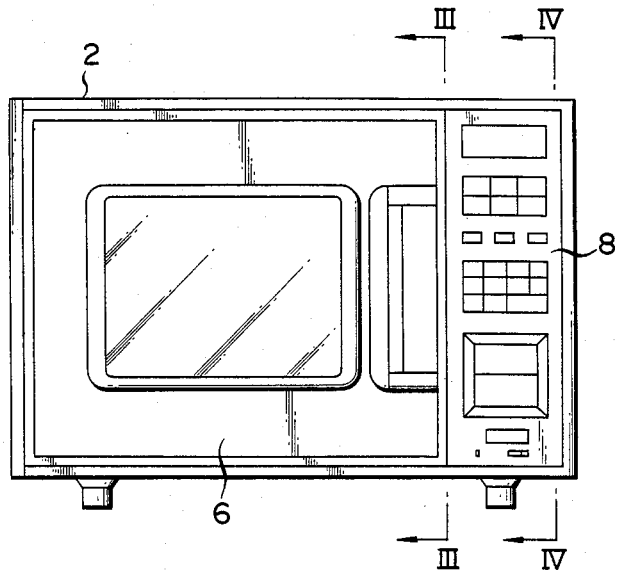
FIG. 1 and FIG. 2 show front and side views respectively of a microwave oven incorporating a menu display device of this invention.
Figure 2:
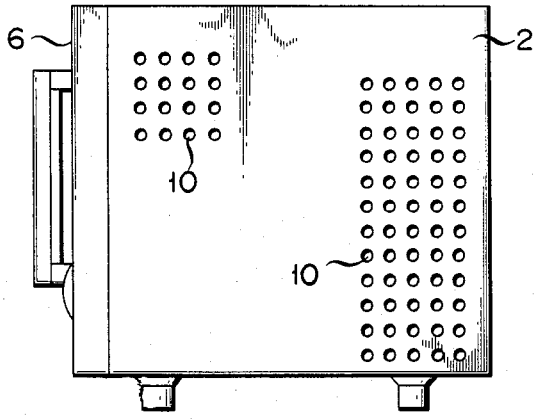
Figure 3:
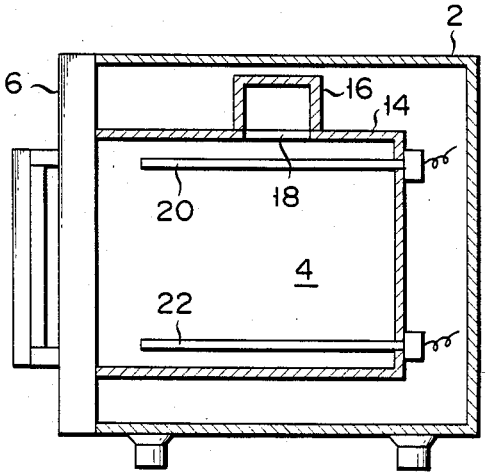
FIG. 3 and FIG. 4 shows cross sectional views of FIG. 1 as taken along lines III—III and IV—IV, respectively.
Figure 4:
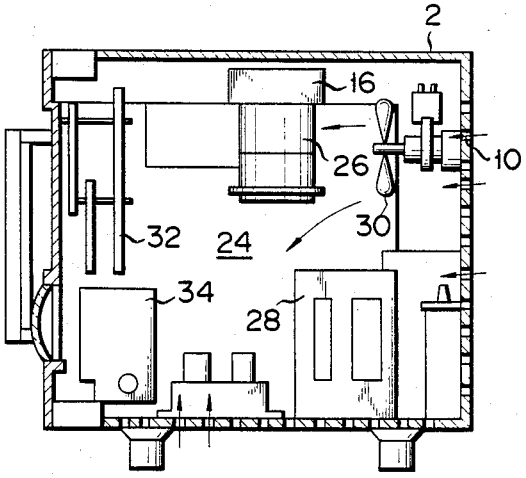

In FIGS. 1 and 2 are shown a front view and side view, respectively, of a microwave oven incorporating a menu display device of this invention. A door 6 of a cooking chamber 4 and front panel 8 are provided on a casing 2 of the microwave oven as shown in FIG. 1 and air holes 10 are provided on the side surfaces, rear surface and bottom surface of the casing 2 as shown in FIG. 2. As shown in FIG. 3 an inner casing 14 is provided in the casing 2 to define the cooking chamber 4. An opening 18 is provided in the top plate of the inner casing 14 to communicate with a waveguide 16 so that microwaves are transmitted therethrough. A pair of heaters 20, 22 are arranged one in the upper section and one in the lower section of the inner casing 14. A magnetron for generating microwaves, transformer 28, cooling fan 30, printed board 32, menu capsule 34, etc. are received in a spacing 24 which is defined by the side surface of the casing 2 and the side surface of the casing 14.

Figure 5:
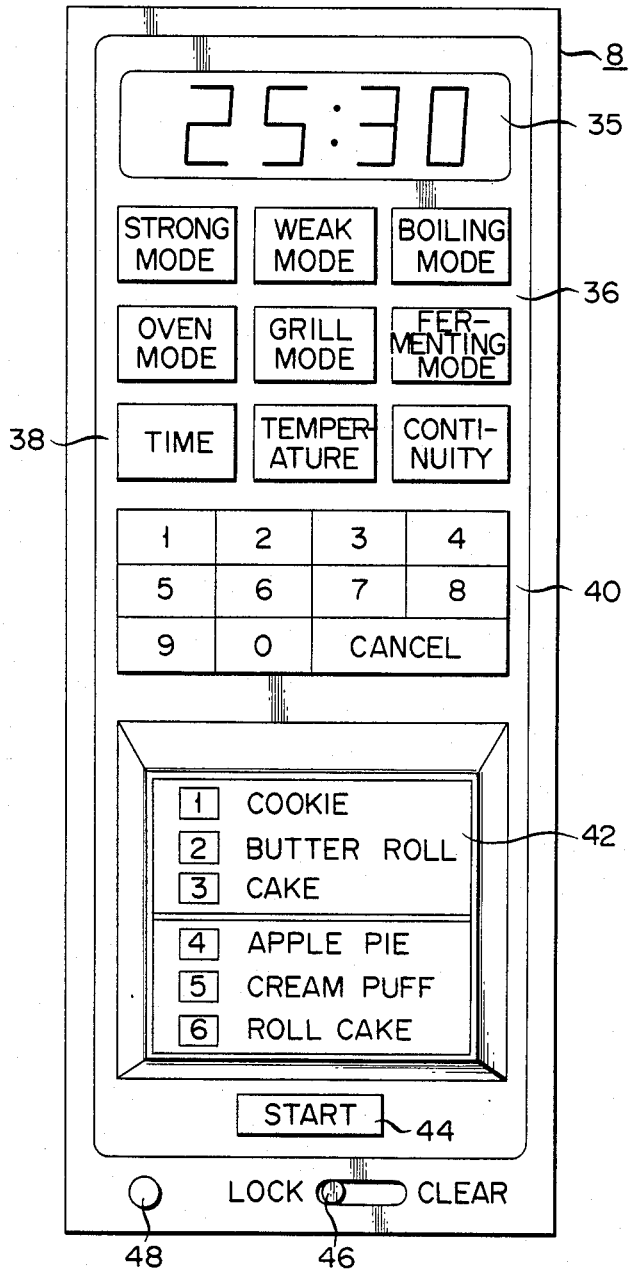
FIG. 5 shows a front view of a front pannel shown in FIG. 1.
Figures 6, 8:
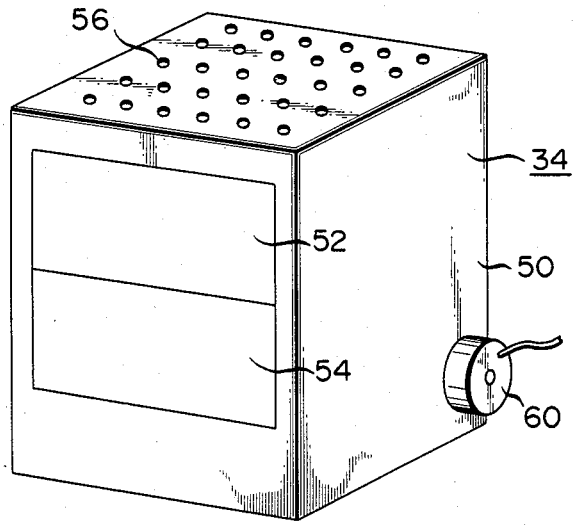
FIG. 6 shows a perspective view of a menu capable of this invention.
FIG. 8 shows detailed descriptions on a pair of menu cards.
Figure 7:
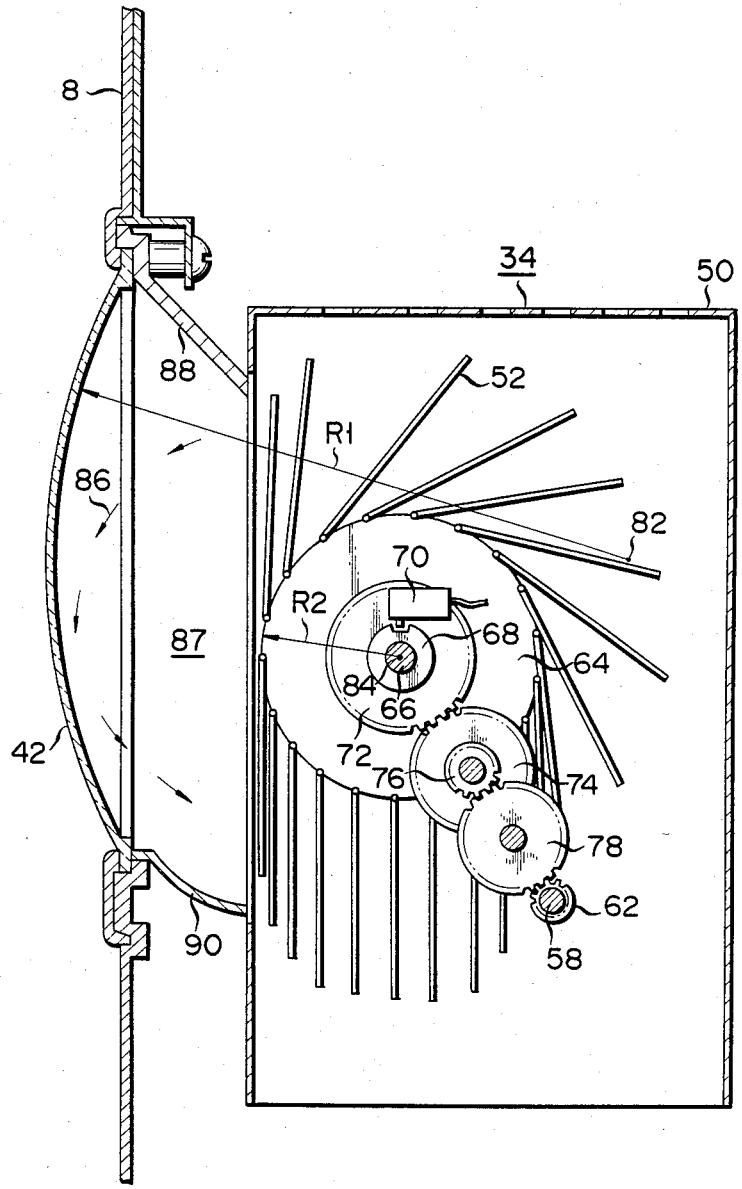
FIG. 7 shows a cross sectional view of the menu capule of FIG. 6 with a transparent cover disposed in front of it.

The magnetron 26 is coupled to the waveguide 16 and the cooling fan 30 is attached to a rear wall of the casing 2 such that it is located in the neighborhood of the magnetron 26. Air is supplied by the cooling fan 30 into the magnetron 26 through the air holes 10 to cool the magnetron. Likewise, the printed board 32 etc. are cooled by an air flow which is caused by the rotation of the cooling fan 30. The air is flowed out through the air holes 10 on the side surfaces of the casing 2. As shown in FIG. 5, the front panel 8 includes a display section 35 for displaying a cooking time, etc., cooking mode selection switches 36 for selecting cooking modes such as microwave outputs mode, boiling mode, oven mode, grill mode, or fermenting mode, and condition setting switches 38 for selecting the conditions of cooking such as the temperature, the time or the continuity. The front panel 8 further includes ten keys 40 for designating cooking menu cards etc., transparent cover 42 for covering the opening of the menu capsule 34, start button 44, lock button 46 for locking a pair of menu cards in place, and menu card button 48 for turning the menu cards. The menu capsule 34 has a housing 50 having an outer configuration as shown in FIG. 6 and the housing 50 has a front opening 54 where the pair of menu cards 52 are visually represented. The housing 50 further includes a bottom opening and a number of air holes 56 at its top wall as shown in FIG. 7. A step motor 60 is fixed to the side wall of the housing 50. As shown in FIG. 7 a menu card bobbin 64 is rotatably supported on a shaft 66 in the housing 50 of the capsule 34. A number of menu cards are substantially equidistantly attached to the outer periphery of the menu card bobbin 64 with their one end free. On the menu cards are shown the kinds of foods as shown in FIG. 5 and the method of cooking of any specific menu item as shown in FIG. 8.

As shown in FIG. 7 a timing cam 68 with a recess is fixed to the shaft 66 of the menu card bobbin 64 and a microswitch 70 is fixed to the housing 50 and has an actuator adapted to be engaged with the timing cam 68. When the actuator of the microswitch 70 is moved into the recess of the timing cam 68 to cause the microswitch 70 to be closed, the items of the menus on the menu cards are visually presented in the front opening 54 of the housing 50 as shown, for example, in FIG. 5. A gear 72 is secured to the shaft of the bobbin 64 and connected through gears 74, 76 and 78 to a pinion 62 which is fixed to a shaft 58 of the step motor 60. The menu capsule 34 is disposed in the casing 2 such that its front opening 54 faces a concave surface of the transparent cover 42 of the front pannel 8. The transparent cover 42 is curved such that it has the radius R1, greater than the radius R2 of the bobbin, as shown in FIG. 7. The convex surface of the cover 42 is attached to the front panel 8 such that it projects from the front panel 8. The center of curvature, 82, of the transparent cover 42 is upwardly deviated from the center 84 of the bobbin 64. That is, the transparent cover 42 is so designed as to permit an increase of external light components incident through the transparent cover 42 to the menu card 52. The transparent cover 42 is so disposed relative to the bobbin 64 as to provide a spacing enough for the menu cards on the bobbin 64 to be turned as indicated by arrows 86. A partition plate (i.e. stopper) 88 is screwed at one end to that portion of the panel where the upper edge of the cover 42 is fixed. The partition plate 88 obliquely extends downward to the extent permitting the other end of the menu card 52 to abut against the partition plate 88. At this position, the pair of menu cards 52 are located substantially perpendicular to the horizontal. A menu card cover 90 is fixed at one end to that portion of the panel where the lower edge of the transparent cover 42 is fixed. The cover 90 is curved substantially along the locus of rotation of the menu card 52.

The operation of the menu capsule 34 will be explained below by referring to FIG. 9.

Figure 9:
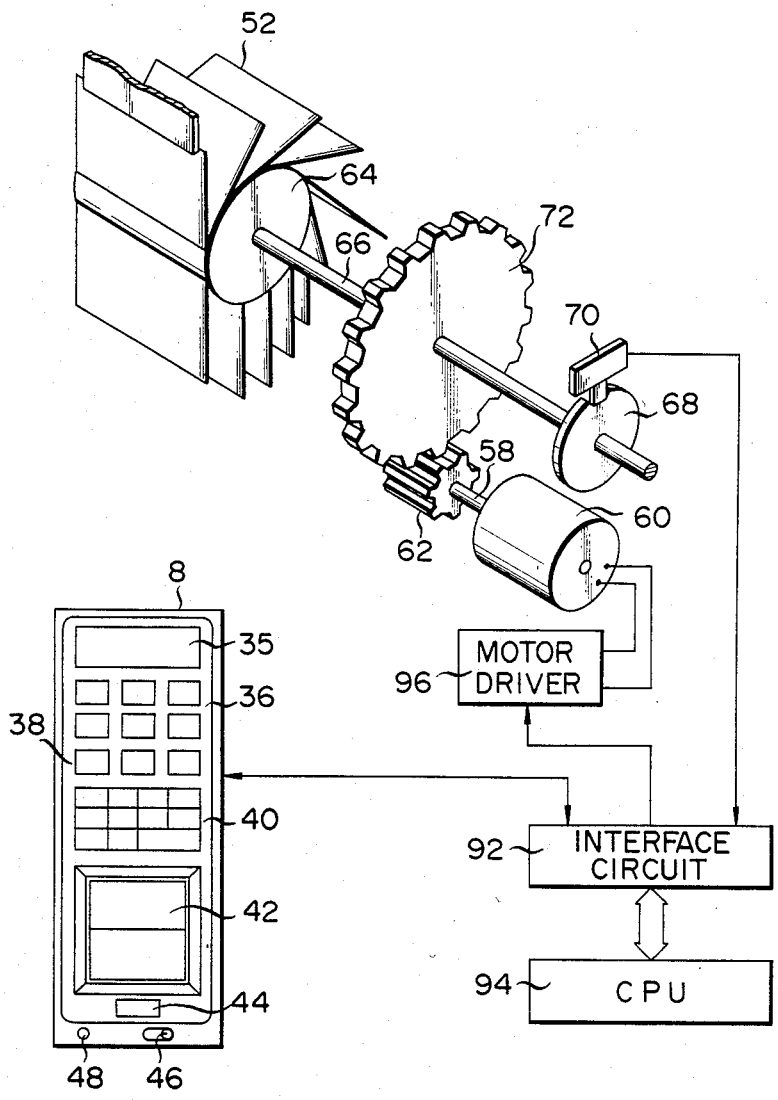
FIG. 9 shows an operation mechanism of the menu capsule.

In FIG. 9 only the gear 72 is shown with the other gears 74, 76 and 78 omitted for the sake of convenience. When the start button 44 of the front panel 8 is initially depressed, a start signal is applied to a CPU 94 through an interface circuit 92. Thus, a drive circuit 92 is operated in response to a motor drive signal supplied from the CPU 94 to cause the motor 60 to be continuously driven. The rotation force of the motor 60 is transmitted to the gear 72, causing the bobbin 64 to be rotated. With the rotation of the bobbin 64 the menu cards on the bobbin 64 are sequentially contacted with the end of the partition wall 88 to force them into the spacing 87 defined by the partition plate 88, transparent cover 42 and menu card cover 90. The menu cards 52 forced into the spacing 87 are turned under their own weight with the base ends of the menu cards as a center, permitting them to be suspended from the surface of the bobbin 64. While the menu cards 52 are sequentially presented in the front opening 54 of the housing 50, the timing cam 68 is rotated in accordance with the rotation of the bobbin 64. When the actuator of the microswitch 70 is moved into the recess of the timing cam 68, the microswitch 70 is closed, causing a stop signal to be imparted to CPU 94 through the interface circuit 92. As a result, a motor stop signal is applied from CPU 94 to the motor circuit 96. At this time, a pair of menu cards 52 are presented such that one is erected with its free end abutted against the other end of the partition plate 88 and the other is suspended from the surface of the bobbin 64. That is, the items of menus on the pair of menu cards are set in order for the user to read them through the transparent cover 42. Suppose, for example, that apple pie is to be cooked. In this case, one of the ten keys 40 i.e. number four key is depressed to designate the menu card for apple pie. A signal for designating the menu item 4 is applied to CPU 94 through the interface circuit 92. CPU 94 supplies a pulse signal, corresponding to the menu item 4, to the motor drive circuit 96, causing the pulse motor 60 to be rotated a predetermined number of times, for example, 5 times. That is, 5 menu cards 52 are sequentially turned by the rotation of the bobbin 64 and a detail of the menu item 4 is set to be visible through the transparent cover 42 as shown in FIG. 8.

In the menu display device of this invention, since the transparent cover 42 convexly projects from the front panel, external light is fully incident onto the surface of the menu cards 52. It is therefore possible for the user to clearly see the descriptions on the menu cards. Taking account of the fact that light fittings are usually attached to the ceiling of a room, the center 82 of curvature of the transparent cover 42 is displaced upwardly with respect to the center of the bobbin 64 and external light is incident with adequate illuminance to the surface of the menu card. The menu cards are held within the menu capsule, preventing the menu cards from receiving any possible thermal deformation due to external heat as well as any possible intrusion of foreign matter, dust, etc., into the gears etc. As the air holes are provided on the menu capsule, better air circulation is obtained within the capsule, avoiding a temperature rise therein. The menu cards can be readily exchanged by the mere insertion of a new menu capsule, because they are held within the menu capsule.

What is claimed is:

1. A menu display device adapted for a cooking apparatus, comprising:

a cylindrical body supported for rotational movement about a center axis;

a plurality of menu cards turnably attached at one end thereof to an outer peripheral surface of said cylindrical body;

a housing in which said cylindrical body and said cards are housed;

means for rotating said cylindrical body;

a curved transparent cover having concave and convex surfaces and a radius of curvature greater than a radius of said cylindrical body, said concave surface of the cover facing said cylindrical body to define a space therebetween through which sald menu cards pass while being turned upon rotation of the cylindrical body, said convex surface of the cover being fixed to said housing such that said convex surface projects from a surface of said housing; and a stopper having an end against which the other end of the menu card abuts and adapted to hold the abutting menu card erect when said cylindrical body is stopped; and wherein said transparent cover has a center of curvature which is upwrdly displaced relative said center axis of said cylindrical body to permit said menu cards to be exposed to an increased amount of external light which passes through said transparent cover.

2. A menu display device according to claim 1, in which said means for rotating said cylindrical body includes a rotation shaft on which said cylindrical body is supported, a first gear mounted on the rotation shaft, a motor connected to said first gear, and means for detecting an initial position of said cylindrical body.

3. A menu display device according to claim 2, in which said detecting means includes cam means defining a recessed surface to establish said initial position and a microswitch operatively connected to said motor and having actuator means engageable with said recess to stop said motor in response to said actuator means engaging said recessed surface to thereby stop rotation of said cylindrical body.

4. In combination with a cooking apparatus, the menu display device of claim 1.

5. A menu display device comprising:

a cylindrical body defining an outer peripheral surface and having a shaft establishing a center axis, said cylindrical body being mounted for rotational movement about said center axis;

plural menu cards each having one end pivotally connected to said outer peripheral surface;

motor means operatively connected to said shaft for rotating said cylindrical body about said center axis;

cam means fixed to and rotatable with said shaft, said cam means defining a cam surface to establish an initial position of said cylindrical body;

a curved transparent cover having a center of curvature and fixedly mounted with respect to said cylindrical body to define therewith a space through which said menu cards pass when said cylindrical body is rotated;

stop means defining an edge against which the other ends of said menu cards abut so that an abutting menu card is in an erect position when rotation of said cylindrical body stops; and control means operatively connected to said motor means and engaged with said cam means, said control means for stopping said motor in response to engagement with said cam surface to thereby stop rotation of said cylindrical body at said initial position.

6. A menu display device as in claim 5 wherein said center of curvature is upwardly displaced relative said center axis to permit said menu cards to be exposed to an increased amount of external light which passes through said transparent cover.

7. A menu display device as in claim 5 wherein said cam surface is a recessed surface.

8. In combination with a cooking apparatus, the menu display device as in claim 5.

* * * * *